US010105614B2

(12) United States Patent
Saifullah

(10) Patent No.: US 10,105,614 B2
(45) Date of Patent: Oct. 23, 2018

(54) ASSEMBLY FOR TACTILE PROMOTION OF SIMPLICITY AND AMUSEMENT

(71) Applicant: Shakila Saifullah, Wichita, KS (US)

(72) Inventor: Shakila Saifullah, Wichita, KS (US)

( * ) Notice: Subject to any disclaimer, the term of this patent is extended or adjusted under 35 U.S.C. 154(b) by 0 days.

(21) Appl. No.: 15/834,239

(22) Filed: Dec. 7, 2017

(65) Prior Publication Data

US 2018/0099228 A1 Apr. 12, 2018

Related U.S. Application Data

(60) Provisional application No. 62/431,256, filed on Dec. 7, 2016.

(51) Int. Cl.

| | |
|---|---|
| ***A63H 3/10*** | (2006.01) |
| ***A63H 3/46*** | (2006.01) |
| ***A63H 3/16*** | (2006.01) |
| ***A63H 7/00*** | (2006.01) |
| ***A63H 3/18*** | (2006.01) |

(52) U.S. Cl.

CPC ..... *A63H 3/46* (2013.01); *A63H 3/10* (2013.01); *A63H 3/16* (2013.01); *A63H 3/18* (2013.01); *A63H 7/00* (2013.01)

(58) Field of Classification Search

CPC ..... A63H 3/08; A63H 3/10; A63H 3/16

See application file for complete search history.

(56) References Cited

U.S. PATENT DOCUMENTS

| | | | | |
|---|---|---|---|---|
| 172,709 A * | 1/1876 | Crandall | | |
| 278,461 A * | 5/1883 | Screven | | |
| 1,702,539 A * | 2/1929 | Gove | A63H 3/10 | 446/376 |
| 3,727,343 A * | 4/1973 | Chiari | A63H 3/46 | 446/361 |

* cited by examiner

*Primary Examiner* — John Ricci

(74) *Attorney, Agent, or Firm* — Kenneth H. Jack; Davis & Jack, L.L.C.

(57) ABSTRACT

An assembly for tactile promotion of simplicity and amusement incorporating a quadruple of rear extraction stops; a quadruple of flexible ties attached to and extending forwardly from the rear extraction stop; a rear torso and head silhouetting sheet having a first quadruple of eyes, wherein the quadruple of flexible ties forwardly extends through the first quadruple of eyes; a quadruple of appendages having proximal ends having a second quadruple of eyes, wherein the quadruple of flexible ties further forwardly extends through the second quadruple of eyes; a front torso and head silhouetting sheet having a third quadruple of eyes, wherein the quadruple of flexible ties further forwardly extends through the third quadruple of eyes; a quadruple of front extraction stops attached to forward ends of the quadruple of flexible ties; and a twig attached to and extending downwardly from the rear and front torso and head silhouetting sheets.

13 Claims, 6 Drawing Sheets

ASSEMBLY FOR TACTILE PROMOTION OF SIMPLICITY AND AMUSEMENT

CLAIM OF PRIORITY FROM PREVIOUSLY FILED PROVISIONAL PATENT APPLICATION

This non-provisional patent application claims the benefit of and priority from U.S. Provisional Patent Application No. 62/431,256 filed Dec. 7, 2016. The inventor and applicant disclosed in said provisional application are the same as the inventor and applicant of the instant application. Structures and functions of structures disclosed and described in the instant application are substantially identical to those disclosed in said provisional application.

FIELD OF THE INVENTION

This invention relates to hand held and hand actuated amusement devices. More particularly, this invention relates to such devices which are adapted for tactily associating and promoting a simplicity ethic with a user's twirling or spinning manipulation of the device.

BACKGROUND OF THE INVENTION

Many of the world's religions, including Islam, Hinduism, Judaism, and Buddhism, teach and emphasize an ethic of simplicity. Another example of the philosophical promotion of such ethic is the Simplicity testimony which is one of the core tenets of Christianity's Religious Society of Friends. The instant inventive assembly furthers such simplicity ethic by incorporating within a hand twirlable amusement figure specialized tactile and visual features which work symbiotically with an amusement feature for promoting and teaching the simplicity ethic.

BRIEF SUMMARY OF THE INVENTION

First structural components of the instant inventive assembly for tactile promotion of simplicity and amusement comprise a quadruple of short flexible ties. In accordance with the instant invention's simplicity ethic teaching and promotion object, such ties preferably comprise natural jute or cotton fibers.

Further structural components of the instant inventive assembly comprise a quadruple of manually tied and untieable knots which are formed at back ends of the quadruple of flexible ties.

A further structural component of the instant inventive assembly comprises a first or back torso and head silhouetting sheet, such component preferably being composed of paper card stock. Such sheet preferably presents left and right shoulder clevis ear or clevis leaf zones and left and right hip clevis ear or clevis leaf zones, each of such zones having a clevis eye or aperture. Each of the flexible ties preferably initially extends forwardly through one of such clevis eyes so that said each tie's back end knot may underlie and may frontwardly engage the back sheet at one of such clevis eyes in the manner of an extraction stop.

Further structural components of the instant inventive assembly comprise depositions of glue or paste which are preferably placed upon a front surface of the back sheet component. Such glue depositions are preferably located over such sheet's upper head silhouetting portion and at a bilateral mid-line position at such sheet's lower torso portion.

A further structural component of the instant inventive assembly comprises a short length of natural twig or tree branch which has an asperous outer bark surface and has a plurality of branch or stem base protuberances. The inclusion within such preferred twig or branch component of the asperous bark surface and the stem protuberances advantageously allows a user of the instant inventive assembly to grasp such component and to tactily feel such features during use of the assembly. Accordingly, the instant invention tactily associates the simplicity of naturally and readily acquired twigs and branches with amusing use of the assembly.

In the preferred embodiment of the instant invention, the upper end of the twig adheres to the back sheet at the torso's lower portion, and a third deposition of glue or paste is thereafter placed upon a front side of the upper end of the twig.

Further structural components of the instant inventive assembly comprise right and left arms and right and left legs, each such appendage having a proximal end. Similarly with the head and torso components, arm and leg components are sheet configured and are preferably composed of paper card stock material. Clevis eyes preferably extend through the proximal ends of the right and left arms and legs, and the front ends of the quadruple of flexible ties are preferably further extended through such clevis eyes.

A further structural component of the instant inventive assembly comprises a front sheet which, like the back sheet and the arms and legs, is preferably composed of card stock paper. Similarly with the front sheet, the back sheet preferably silhouettes head and torso portions, and forms left and right shoulder and hip clevis ears or leaves. Similarly with the preferred configuration of the back sheet, clevis eyes are preferably positioned at the front sheet's left and right shoulder clevis ear/leaf zones and at such sheet's left and right hip clevis ear/leaf zones.

Upon the further forward extensions of the invention's quadruple of flexible ties through the front sheet's clevis eyes, a back or inner surface of the front sheet advantageously comes into adhesive contact with the first and third depositions of glue or paste which reside upon the head portion of the back sheet and upon the upper front surface of the twig.

Further structural components of the instant inventive assembly comprise a second or frontward quadruple of manually tied and manually untieable knots, such knots preferably being formed at front ends of the flexible ties. In the preferred embodiment, the front quadruple of knots backwardly abuts the front surface of the front sheet, and operates as an extraction stop with respect to such sheet's quadruple of clevis eyes. Upon the formation of the second or front quadruple of knots at the front ends of the flexible ties, a quadruple of pin, eye, and clevis pivot joints are advantageously formed at the assembly's proximal arm and leg ends.

In use of the instant invention, a user may initially view the assembly's twig and knot components, and may visually perceive the simplicity character of those components. Thereafter, the user may grasp the twig component between the palms of his or her hands, and may reciprocatingly move palms forwardly and rearwardly with respect to each other, such action turning and counter-turning the twig component and all of the upwardly attached components. Upon such palm actuated turning motions, the user advantageously tactily senses and feels the assembly's simple bark and twig protuberance features. Simultaneously with the palm induced rolling and counter-rolling of the twig component, the arm and leg components are centripetally accelerated, causing them to raise and lower in an animated and amusing fashion. Such amusement function is performed simultaneously with the user's visual and tactile perceptions of the invention's simplicity features, enhancing the invention's simplicity ethic promoting function. The invention's simple knot configured clevis pin stays advantageously allow for easy tying and untying in order to release the invention's pivoting clevis joints and in order to interchange or replacement appendage parts.

Accordingly, objects of the instant invention include the provision of an assembly for tactile promotion of simplicity and amusement which incorporates structures as described above, and which arranges those structures in r elation to each other in manners described above for the achievement of the beneficial functions described above.

Other and further objects, benefits, and advantages of the instant invention will become known to those skilled in the art upon review of the Detailed Description which follows, and upon review of the appended drawings.

DETAILED DESCRIPTION OF A PREFERRED EMBODIMENT

Figure 1:
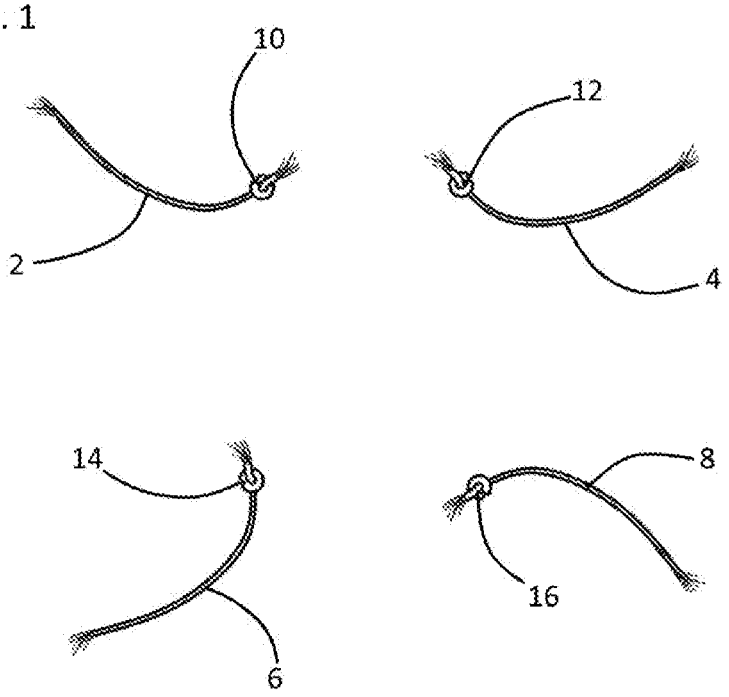
FIG. 1 is a view of flexible tie components of the instant inventive assembly for tactile promotion of simplicity and amusement.

Referring now to the drawings, and in particular to Drawing FIG. 1, a quadruple of flexible ties 2, 4, 6, and 8 are preferably provided. For purposes of consonance with the instant invention's simplicity ethic teaching and promoting object, the ties 2, 4, 6, and 8 are preferably composed of natural jute fibers or cotton fibers which, in their twine or string forms, are easily and simply threaded and knotted. Clevis pin extraction stops in the form of knots 10, 12, 14, and 16 are preferably tied at the back or rearward ends of each of the flexible ties 2, 4, 6, and 8.

Figure 2:
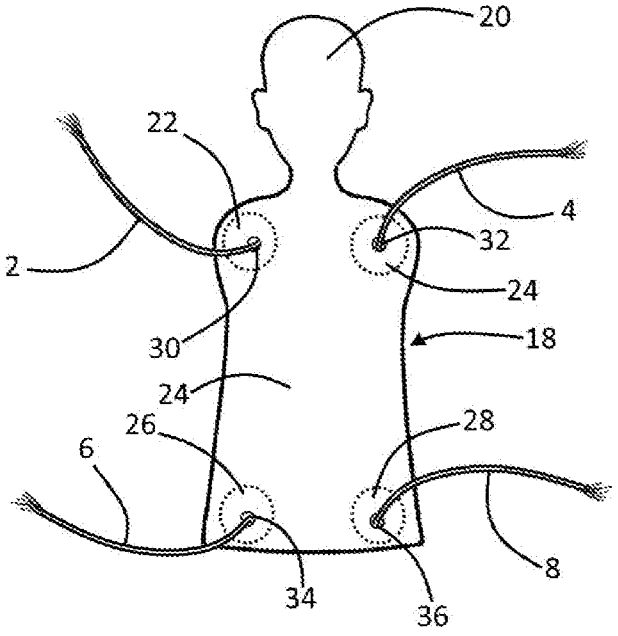
FIG. 2 redepicts the structure of FIG. 1, the view of FIG. 2 further showing a rearward torso and head silhouetting sheet component.
Figure 3:
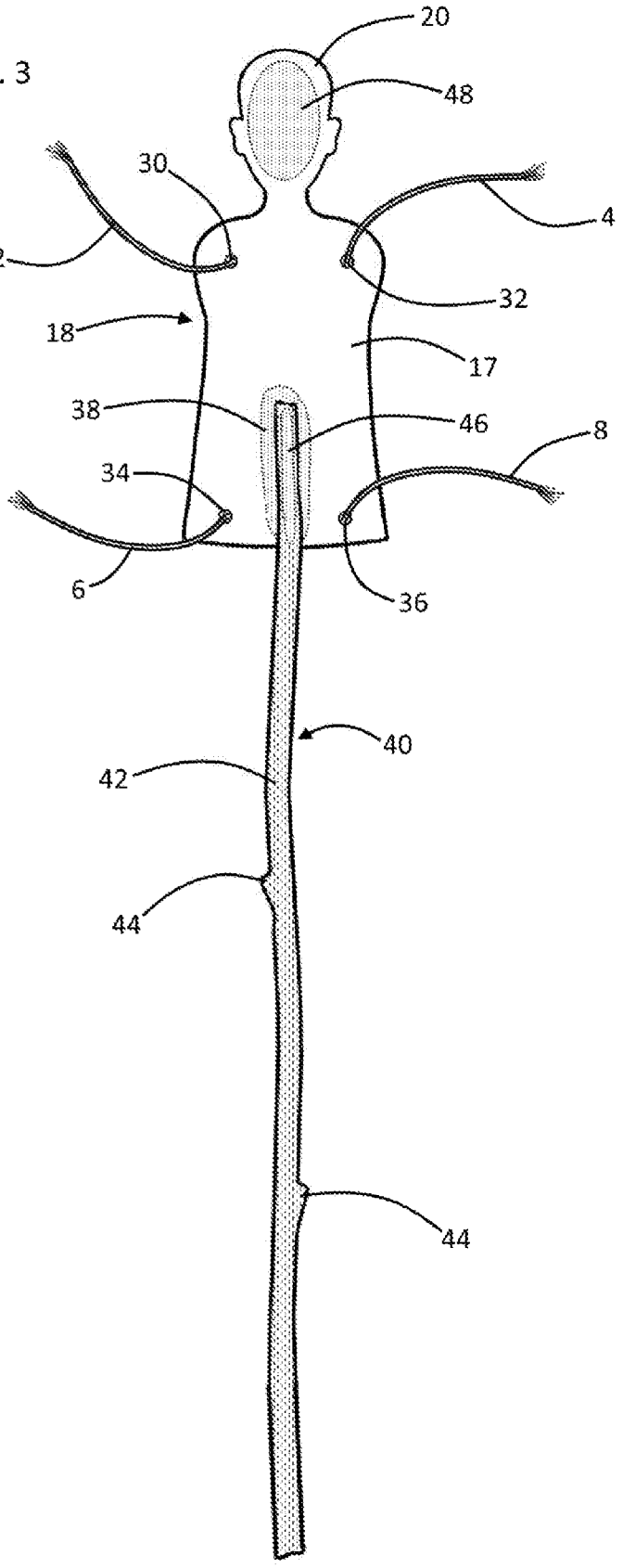
FIG. 3 redepicts the structures of FIGS. 1 and 2, the view of FIG. 3 further showing glue depositions and a twig component.

Referring simultaneously to FIGS. 1 and 2, a back or rearward sheet 18 having an upper head silhouetting portion 20 and a lower torso silhouetting portion 17 is provided, such sheet 18 preferably being composed of card stock paper. The torso silhouetting portion 17 of the back sheet 18 preferably defines right and left shoulder clevis ear or clevis leaf zones 22 and 24, and further defines right and left hip clevis ear or clevis leaf zones 26 and 28. In the preferred embodiment, such clevis component zones have perforated clevis eyes 30, 32, 34, and 36. The front ends of flexible ties 2, 4, 6, and 8 are preferably manually threaded forwardly through clevis eyes 30, 32, 34, and 36, until the knots 10, 12, 14, and 16, abut and stop against the back surface of sheet 18.

In accordance with the invention, a small tree branch or twig 40 having an asperous bark surface 42 and having a plurality of stem base protuberances 44 is preferably provided. The twig's bark surface and protuberances advantageously visually and tactily communicate simplicity features which are associated with the twig's common presence in nature. Depositions of glue or paste 38 and 48 are placed upon the inner surfaces of the head 20 and the torso 17, and the upper end of the twig 40 is bonded with the torso 17 at the torso's glue deposition 38. A third deposition of glue 46 is preferably applied to the front surface of the upper end of the twig 40.

Figure 4:
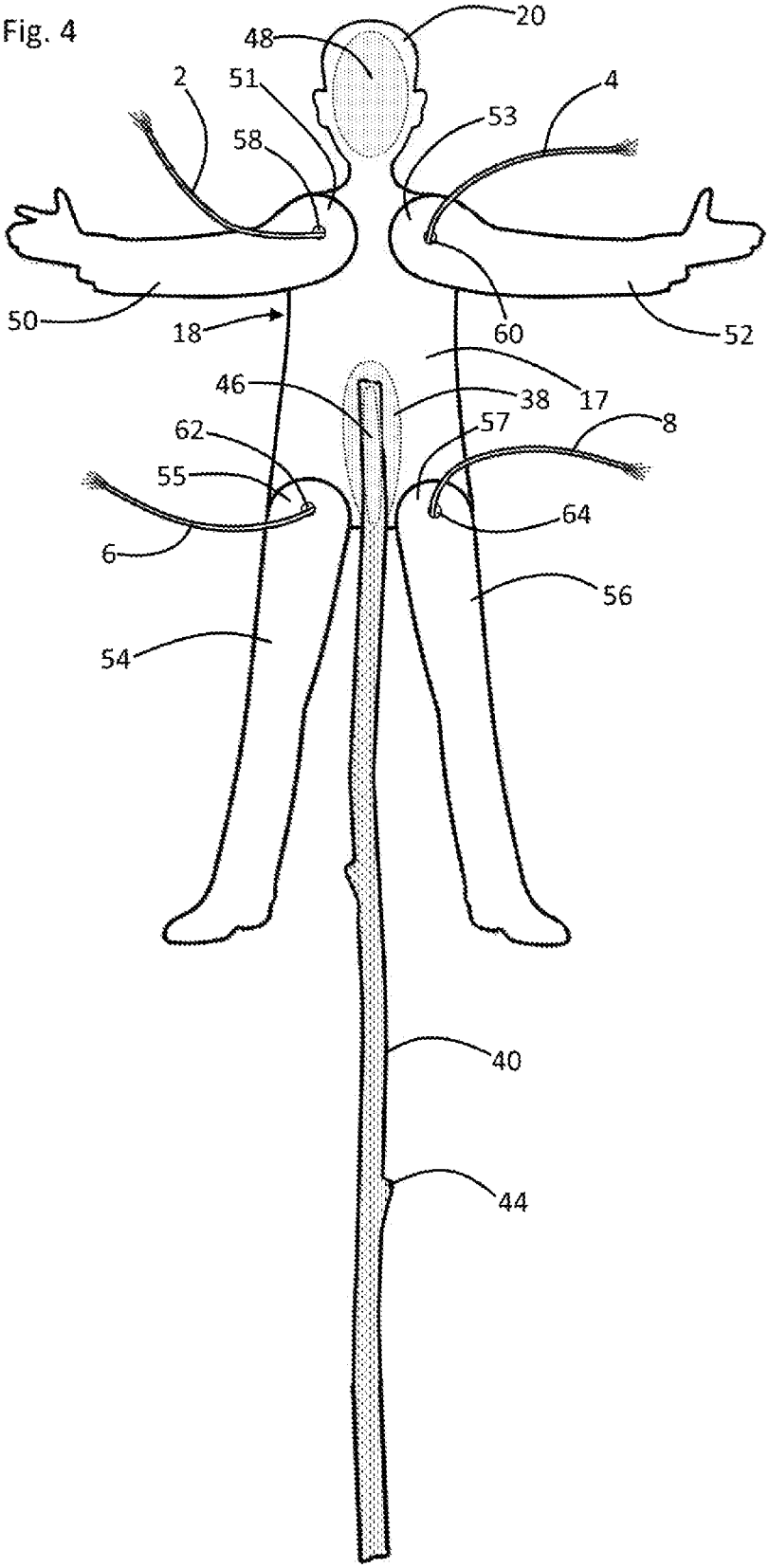
FIG. 4 redepicts the structures of FIGS. 1-3, the view of FIG. 4 further showing arm and leg components.

Referring to FIG. 4, the instant inventive assembly preferably further comprises a plurality of appendages in the form of right and left arms 50 and 52 and right and left legs 54 and 56, such arms and legs having clevis eyes 58, 60, 62, and 64 at their proximal ends 51, 53, 55, and 57. Similarly with the forward extensions of the flexible ties 2, 4, 6, and 8, through clevis eyes 30, 32, 34, and 36, such ties are preferably further forwardly threaded through the appendages' clevis eyes 58, 60, 62, and 64.

Figure 6:
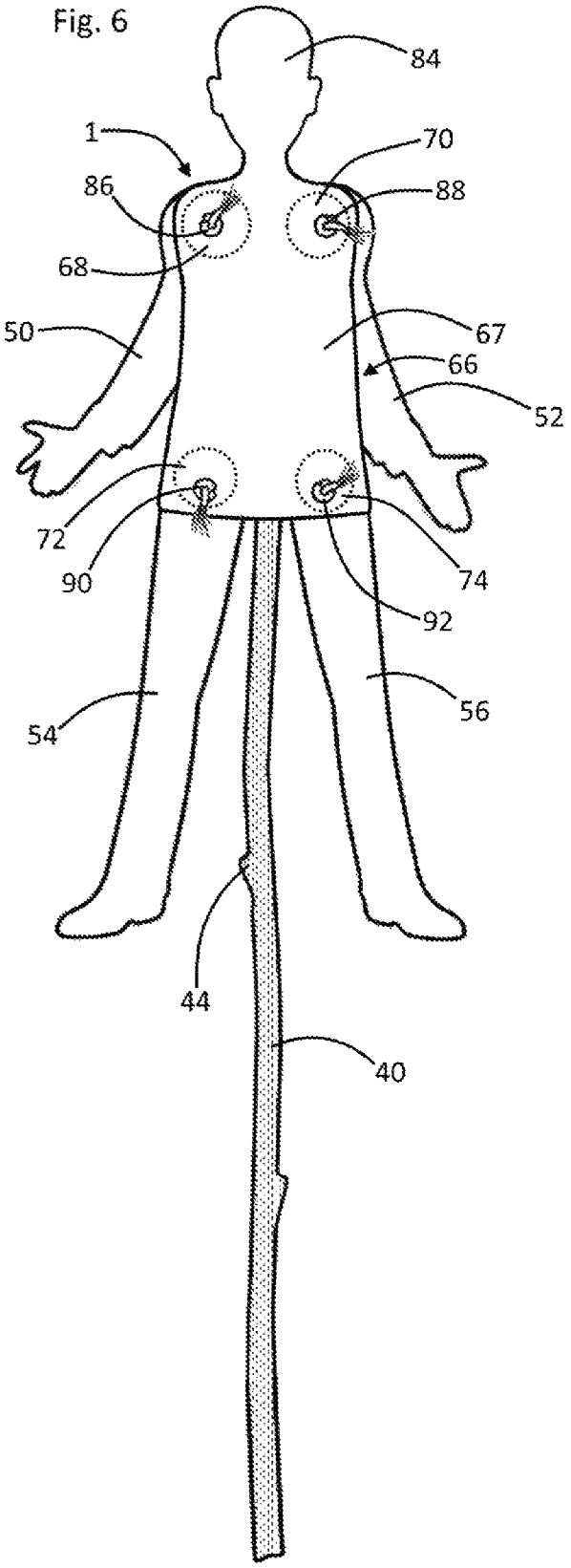
FIG. 6 redepicts the structure of FIG. 4, the view of FIG. 6 showing an installation of the FIG. 5 front sheet component.
Figure 5:
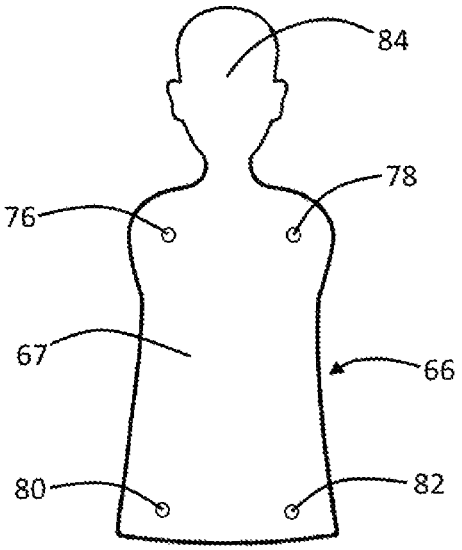
FIG. 5 shows a frontward head and torso silhouetting sheet component.

Referring simultaneously to FIGS. 4-6, a front sheet 66, which like the back sheet 18 is preferably composed of card stock paper, has a head silhouetting portion 84 and a torso silhouetting portion 67. Similarly with the back sheet's clevis forming zones 22, 24, 26, and 28, the front sheet 66 has left and right shoulder clevis forming zones 68 and 70, and has left and right hip clevis forming zones 72 and 74. A third quadruple of clevis eyes 76, 78, 80, and 82, preferably extends through such zones 68, 70, 72, and 74, and the flexible ties 2, 4, 6, and 8, are preferably further forwardly threaded through such clevis eyes 76, 78, 80, and 82. Thereafter, a quadruple of front knots 86, 88, 90, and 92, are preferably manually formed upon the flexible ties for service as forward clevis pin securing stops.

Substantially simultaneously with the forward extensions of the flexible ties through the clevis eyes 76, 78, 80, and 82, a back or inner surface of the front sheet 66 advantageously adheres to the upper front end of the twig 40 at the glue deposition 46, while the front sheet's head silhouetting portion 84 adheres to the back sheet's head silhouetting portion 20.

Referring to FIG. 6, Reference Arrow 1 identifies the completed assembly of the invention. In the assembly 1, clevis forming zones 22, 24, 26, 28, 68, 70, 72, and 74, in combination with proximal appendage ends 51, 53, 55, and 57, in further combination with clevis eyes 30, 32, 34, 36, 58, 60, 62, 64, 76, 78, 80, 82, and in further combination with the clevis pin forming ties 2, 4, 6, and 8 and their front and rear knots 86, 10, 88, 12 , 90, 14, 92, and 16, advantageously form a quadruple of simply configured hinge attachments.

In a preferred embodiment, the front surface of the front sheet 66, the back surface of the back sheet 18, and the front and back surfaces of the arms 50 and 52, and legs 54 and 56, may be graphically decorated in conformity with the appearance of various types of animated characters having arms and legs.

Figure 7:
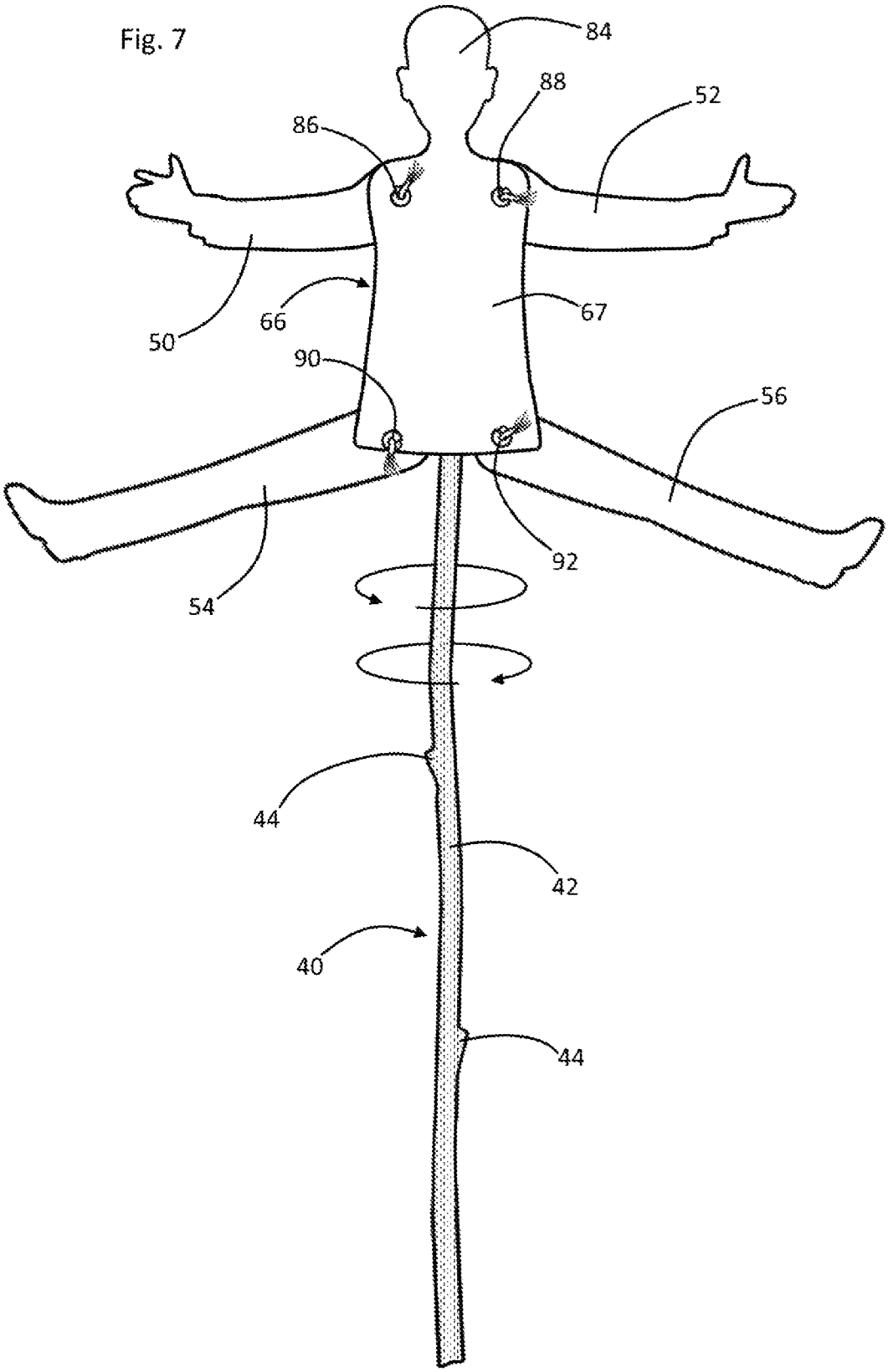
FIG. 7 depicts the instant inventive assembly in twirling motion.
Figure 8:
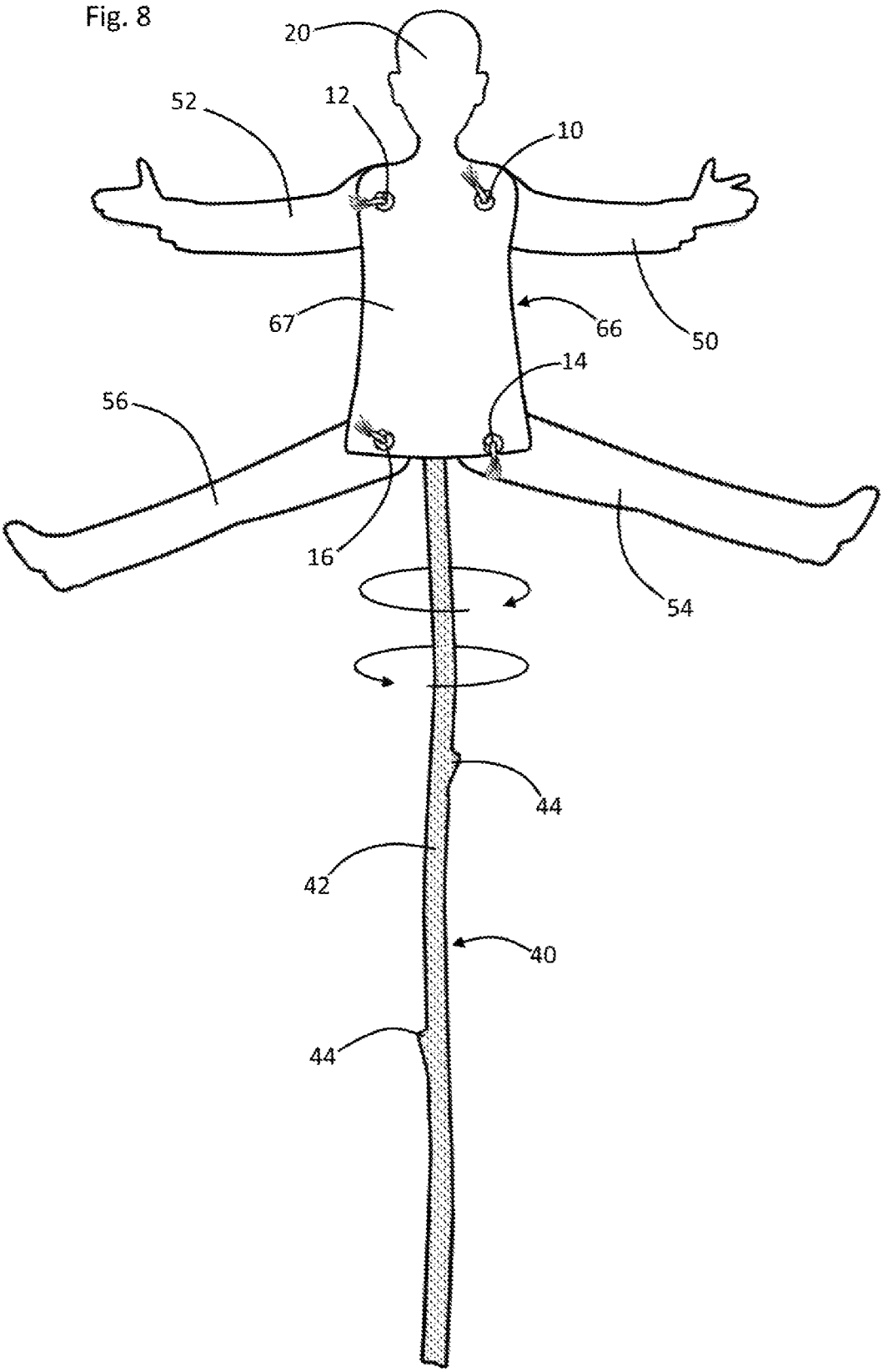
FIG. 8 is a reverse view of the structure of FIG. 7.

In use of the instant inventive assembly, a user may grasp the twig 40 between his or her palms and may reciprocatingly move his or her hands forwardly and rearwardly with respect to each other. Such hand motion rolls and counterrolls the twig 40 in the directions of the elliptical arrows drawn in FIGS. 6 and 7. Such hand actuated rotation advantageously causes the character's arms 50 and 52, and legs 54 and 56, move in an amusing and animated fashion between the downward positions depicted in FIG. 6, and the upward positions depicted in FIGS. 7 and 8.

During the user's palm rolling manipulations of the twig 40, the asperous bark surface 42 and the stem base protuberances 44 are felt and tactily perceived by the user, while other simplicity ethic teaching features of the invention, such as its manually tied hinge knots are simultaneously visually perceived. Such simultaneity of simplicity ethic teaching perceptions and amusement constitutes an intended beneficial function of the invention, wherein, by virtue of the simultaneity, the perceptions and the amusement mutually reinforce each other.

While the principles of the invention have been made clear in the above illustrative embodiment, those skilled in the art may make modifications to the structure, arrangement, portions and components of the invention without departing from those principles.

Accordingly, it is intended that the description and drawings be interpreted as illustrative and not in the limiting sense, and that the invention be given a scope commensurate with the appended claims.

The invention hereby claimed is:

1. An assembly for tactile promotion of simplicity and amusement comprising:

(a) a quadruple of rear extraction stops;

(b) a quadruple of flexible ties fixedly attached to and extending forwardly from the rear extraction stops;

(c) a rear torso and head silhouetting sheet having a first quadruple of eyes, wherein the quadruple of flexible ties further forwardly extends through said quadruple of eyes;

(d) a quadruple of appendages having proximal ends having a second quadruple of eyes positioned at the appendages' proximal ends, wherein the quadruple of flexible ties further forwardly extends through the second quadruple of eyes;

(e) a front torso and head silhouetting sheet having a third quadruple of eyes, wherein the quadruple of flexible ties further forwardly extends through the third quadruple of eyes;

(f) a quadruple of front extraction stops fixedly attached to forward ends of the quadruple of flexible ties; and (g) a downwardly extending twig, said twig being either fixedly attached to the rear torso and head silhouetting sheet or being fixedly attached to the front torso and head silhouetting sheet.

2. The assembly of claim 1 wherein the twig is fixedly attached to both the rear and front torso and head silhouetting sheets.

3. The assembly of claim 2 wherein the twig is asperous.

4. The assembly of claim 3 wherein the stem comprises a plurality of stem base protuberances.

5. The assembly of claim 3 wherein the quadruple of flexible ties comprises strings.

6. The assembly of claim 5 wherein the rear and front quadruples of extraction stops comprise knots.

7. The assembly of claim 6 wherein the rear and front torso and head silhouetting sheets comprise left and right shoulder clevis leaves and comprise left and right hip clevis leaves.

8. The assembly of claim 7 wherein the first and third quadruples of eyes are positioned at the left and right shoulder and hip clevis leaves.

9. The assembly of claim 8 wherein the appendages comprise an arm pair and a leg pair.

10. The assembly of claim 9 wherein the arm pair is pivotally received between the shoulder clevis leaves and wherein the leg pair is pivotally received between the hip clevis leaves.

11. The assembly of claim 10 wherein head portions of the back and front torso and head silhouetting sheets are adhesively bonded to each other.

12. The assembly of claim 11 wherein the twig has an upper end, and wherein the fixed attachment of the twig to the back and front torso and head silhouetting sheets positions said upper end between said sheets.

13. The assembly of claim 12 wherein the fixed attachment of the twig to the back and front torso and head silhouetting sheets comprises adhesive bonds.

* * * * *